US005901440A

United States Patent [19]

Maeda et al.

[11] Patent Number: 5,901,440

[45] Date of Patent: May 11, 1999

[54] CONTROL METHOD OF TERMINAL CRIMPING DEVICE

[75] Inventors: Tatsuya Maeda; Chiaki Hatano, both of Shizuoka, Japan

[73] Assignee: Yazaki Corporation, Tokyo, Japan

[21] Appl. No.: 08/872,147

[22] Filed: Jun. 10, 1997

[30] Foreign Application Priority Data

Jun. 12, 1995 [JP] Japan ..... 8-151140

[51] Int. Cl.[6] ..... H01R 43/04

[52] U.S. Cl. ..... 29/863; 29/705; 29/748; 29/753

[58] Field of Search ..... 29/863, 753, 705, 29/748; 72/412, 441

[56] References Cited

U.S. PATENT DOCUMENTS

| | | | |
|---|---|---|---|
| 4,856,186 | 8/1989 | Yeomans | 29/863 |
| 4,916,810 | 4/1990 | Yeomans | 29/863 |
| 5,092,026 | 3/1992 | Klemmer et al. | 29/863 X |
| 5,123,165 | 6/1992 | Strong et al. | 29/863 X |
| 5,195,042 | 3/1993 | Ferraro et al. | 29/863 X |
| 5,197,186 | 3/1993 | Strong et al. | 29/863 |
| 5,727,409 | 3/1998 | Inoue et al. | 29/863 X |

FOREIGN PATENT DOCUMENTS 8-236253 9/1996 Japan .

*Primary Examiner*—Carl J. Arbes
*Attorney, Agent, or Firm*—Armstrong, Westerman, Hattori, McLeland & Naughton

[57] ABSTRACT

A method of controlling the terminal crimping device is proposed by providing an elevating crimper for crimping terminals onto exposed conductors of cables, positioning an anvil opposite to said crimper, elevating the drive means including a servo motor. The standard value for determining whether or not the crimper height is out of conformity with the standard value, the administration value for administering the crimper height, and the decision value for determining whether or not the crimping performance is good or not on the basis of the crimper height are recorded such that an alarm is issued when the crimper height is out of conformity with said standard value, said administration value, and said decision value at the time of terminal crimping operation.

3 Claims, 10 Drawing Sheets

CONTROL METHOD OF TERMINAL CRIMPING DEVICE

BACKGROUND OF THE INVENTION

1. Field of the Invention

The present invention relates to a method of controlling a terminal crimping device which produces terminal-equipped cables constituting a wire harness or the like.

2. Description of the Prior Art

The terminal crimping device is, in general, composed of a crimper and an anvil set opposite to said crimper wherein the crimper performs the work of crimping terminals to the exposed conductors of the cables through elevating actions thereof. In this connection, the Japanese Patent Appln. No. 6-328827 discloses that the elevating actions are achieved by decelerating the rotation of the servo motor before being transmitted to a disk where the disk rotation is converted into a linear motion such that a ram loaded with said crimper is elevated and lowered. A detailed explanation thereof will be given with reference to FIGS. 10A and 10B and FIG. 11.

FIGS. 9A through 9C are figures explaining the action of the terminal crimping device; FIG. 10A is a graph showing the relationship between the crimper action time and the elevating speed; and FIG. 10B is a graph showing the relationship between the time and the motor current value wherein 1, 2, 3, in FIGS. 10A and 11B correspond to A, B and C in FIG. 9.

Referring to FIG. 9, the disk 7 is secured to the output shaft of the decelerator (not shown), which functions to decelerate the rotation of the servo motor.

The disk 7 secured at an axis thereof to the output shaft of the decelerator carries all eccentric pin (crank shaft) 8 thereon. A crank rod 9 pivotally attached at an upper end thereof to said eccentric pin 8 while said crank rod 9 is pivotally attached at a lower end thereof to a ram 11. Said ram 11 is loaded slidably in a vertical direction within a ram guide which is provided within the inner surfaces of a frame (not shown). In this way, the disk 7, the crank rod 9, the ram 11 and the ram guide constitute a piston/crank mechanism.

The ram 11 is formed at a lower end thereof an engagement recess 13, which is removably loaded with an engagement head 16 of a crimper holder 15 carrying a crimper 14. Immediately beneath said crimper 14, an anvil 17 is secured to a base 2 positioned opposite to said crimper 14.

FIG. 9A shows the start of the crimping step in which the crank pin 8 of the disk 7 takes an uppermost position to place the crimper 14 in the top dead center, when the descending speed of the crimper 14 stands at 0 while the load current stands at 0 as shown in FIG. 10A.

FIG. 9B shows a rotation of the disk 7 in the arrow-marked direction which causes the eccentric pin 3 to move downward until the crimper 14 reaches a position in its high speed descent to contact the barrel c of a terminal, thus starting a crimping action therefor. The descending speed of said crimper 14 is reduced before the contact thereof while reducing the load current.

FIG. 9C shows that the disk 7 rotates in the arrow-marked direction to move the eccentric pin 8 to the neighborhood of the bottom dead center such that the crimper 14 and the anvil 17 substantially performs the crimping work and, then, the crimper 14 provisionally comes to a stop at the crimpinq position. At this time, the crimper 14 is at rest (stop time t) showing a speed 0 while maintaining the state of pressurizing and pinching the barrel c of the terminal to continue the pressurizing action against the springback of the terminal barrel c, thus the load current reaching the peak value while showing a rising curve. Springback of said barrel c is prevented through this pressurizing and pinching action by this provisional halt.

After the terminal crimping, the servo motor 4 is caused to rotate the disk 7 in a direction reverse to the arrow-marked direction in the state shown in FIG. 9C such that the crimper 14 ascends to restore to the state A.

In FIGS. 10A and 10B, the descending speed of the crimper 14 is sufficiently reduced from the speed thereof shown during the descent from the uppermost position to the terminal crimping start position. Therefore, such impact noise as caused in a conventional flywheel type terminal crimping device will not be generated, thus contributing to noise prevention and job site improvement.

The determination whether the terminal crimping performance is good or not has been done by recording as shown in FIG. 11 the reference values of crimping torques (motor drive electric current) to the time for terminal press attaching (between (iii) and (iv) of FIG. 10B and the reference values of the outputs from the height sensor to the time; comparing the actual torque required in crimping operation and the output value of the height sensor with the reference values; and determining the performance as being good if within the prescribed value ranges and as being not good if out of the same.

As set forth in the foregoing description, the determination whether the terminal crimping performance is good or not has been done by conducting the comparison with the reference values to the recorded time as mentioned in the foregoing description. Therefore, any fluctuation in the motor rotation can create a different reference value to cause an error in the determination result.

SUMMARY OF THE INVENTION

An object of the present invention is to provide an improved method of controlling a terminal crimping device which will perform a reliable determination of the terminal crimping operation.

In order to solve the aforementioned problem, the method of controlling the terminal crimping device according to the present invention is characterized in that a terminal crimping device is composed of an elevating crimper for crimping terminals on exposed conductors of cables and an anvil positioned opposite said elevating crimper wherein said crimper is caused by drive means including a servo motor to perform an elevating action, said method comprising the steps of recording a standard value for determining whether or not a height of the crimper is out of conformity with said standard value, an administration value for administering the height of the crimper and a determination value for determining whether the terminal crimping performance is good or not on the basis of the height of the crimper; and issuing an alarm when said height of the crimper at the time of terminal crimping operation is out of conformity with said standard value, said administration value or said determination value.

The determination whether the terminal crimping performance is good or not is effected by monitoring the height of the crimper at the time of terminal crimping operation and a load applied to said drive means; and comparing a load to the detected height with a preset reference data.

Since the reference value to the height of the crimper at the time of terminal crimping operation, an administration value and a determination value are established for comparison and an alarm is issued when said height of the crimper at the time of terminal crimping operation is out of conformity with said standard value, said administration value or said determination value in the present invention, the device of a simple construction can reliably determine the performance whether the terminal crimping operation is good or not.

Further, since the determination whether the terminal crimping performance is good or not is effected by determining the torque value to the height of the crimper, the determination can be effected reliably even in the event of change in the torque due to the heat from the servo motor which is continuously run to operate the crimping device.

The above and other object and features of the present invention will be more apparent from the following description taken in conjunction with the accompanying drawings.

DESCRIPTION OF THE PREFERRED EMBODIMENTS

Figure 1:
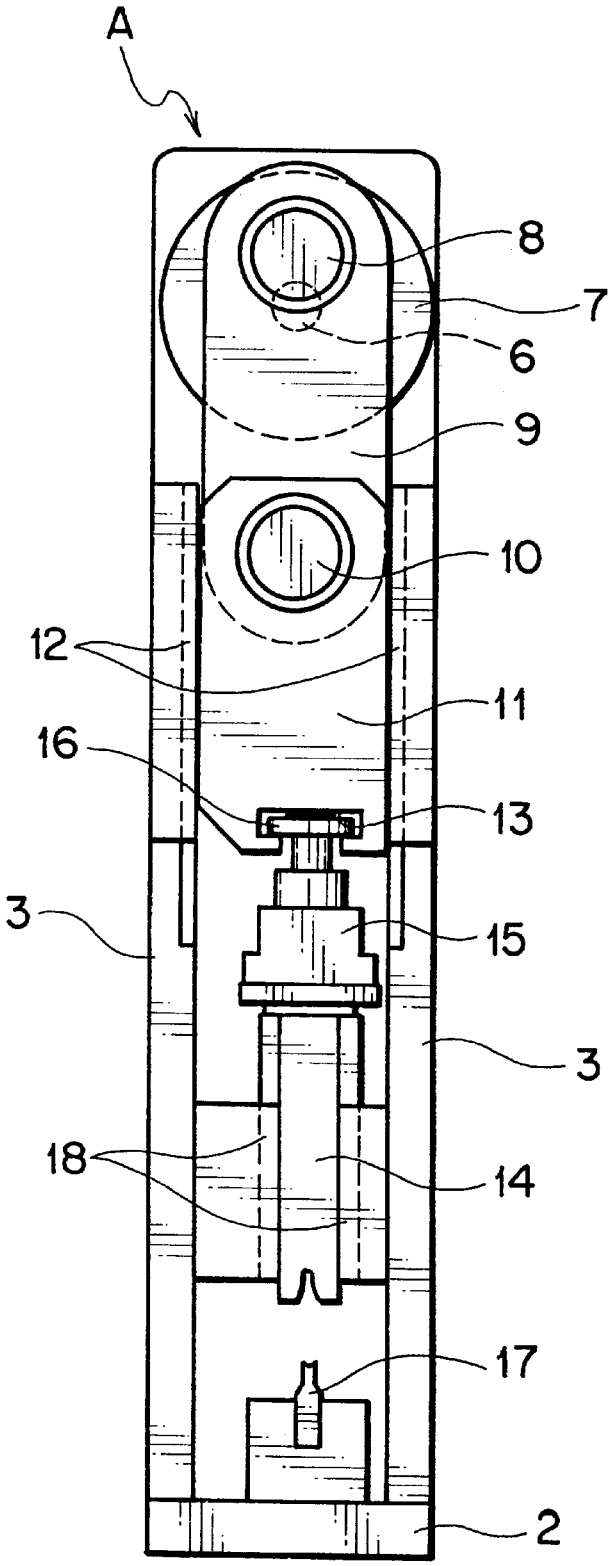
FIG. 1 is a front view of the terminal crimping device, showing one embodiment of the present invention.
Figure 2:
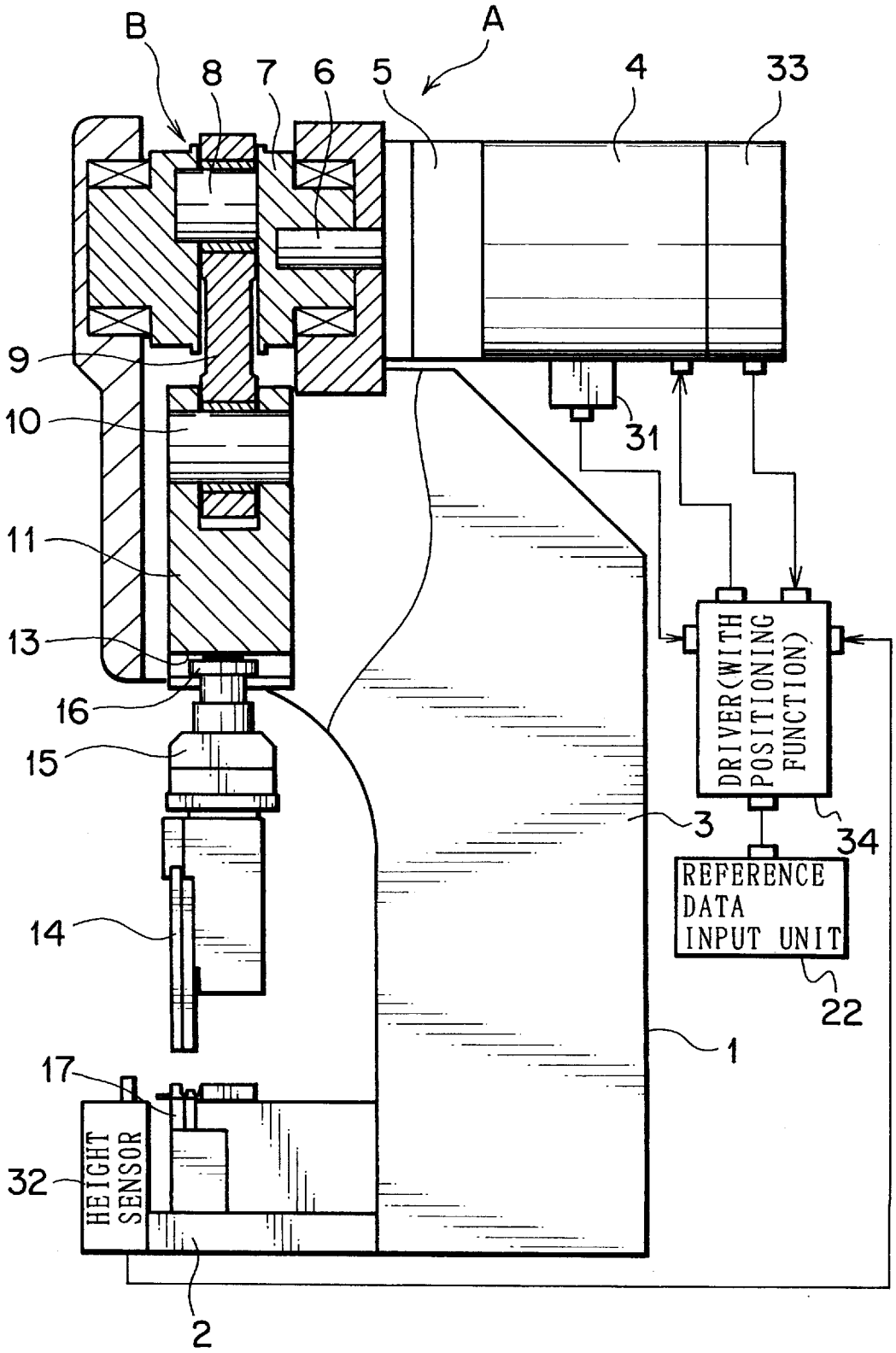
FIG. 2 is a side elevation of FIG. 1.

In FIGS. 1 and 2, reference numeral 1 denotes a casing of a terminal crimping device A which is generally composed of a base 2 and opposite side plates 3 thereof. Above said opposite side plates 3, a servo motor 4 having a reduction gear 5 is mounted thereto to extend rearwardly thereof. Said reduction gear 5 has an output shaft 6 which is secured to a disk 7 having an eccentric pin (crank shaft) 8. There is provided a crank rod 9 having an upper end pivotally attached to said eccentric pin 8. Said crank rod 9 further has a lower end again pivotally attached to a ram 11 via a pin shaft 10. Said ram 11 is loaded within ram guides 12 attached to the inner walls of said opposite side plates 3 such that said ram 11 is adapted to slide upwardly and downwardly therebetween. Thus, the disk 7, the crank rod 9 and the ram guides 12 constitute a piston/crank mechanism B.

The ram 11 is formed with an engagement recess 13 at an underside thereof such that an engagement head 16 formed in the crimper holder 15 attached to the crimper 14 is removably engaged in said engagement recess 13. Immediately beneath said crimper 14, there is set an anvil 17 mounted on the base 2 in opposite relation to said crimper 14. The numeral 18 denotes guide plates for guiding the crimper holder 15 which are secured to the inner faces of the side plates 3 by way of brackets not shown.

The servo motor 4 is adapted to rotate forwardly and backwardly such that the piston/crank mechanism B causes the ram 11 pivotally attached to the crank rod 9 and, thus, the crimper 14 to descend and ascend, said motor 4 being connected to the driver 34 which controls the operation thereof. A reference data input unit 22 to the driver 34 is connected to said driver 34 for inputting thereto reference data including terminal standards (or sizes), cable sizes corresponding thereto, crimper heights (or lowest crimper positions) and loads (or electric currents) applied to the servo motor 4 or the like.

The servo motor 4 has an output shaft (not shown) attached to a rotary encoder 33 which detects positions of the crimper 14 on the basis of the number of its rotation to be fed back to the driver 34 which reads out said load current.

Numeral 32 denotes a height sensor which detects the height of the crimper 14 at the time of terminal crimping operation to input the same to the driver 34 for determining whether the performance of the terminal attaching operation is good or not. The numeral 31 denotes a temperature sensor for measuring the temperature of the coil of the servo motor 4.

Figure 3:
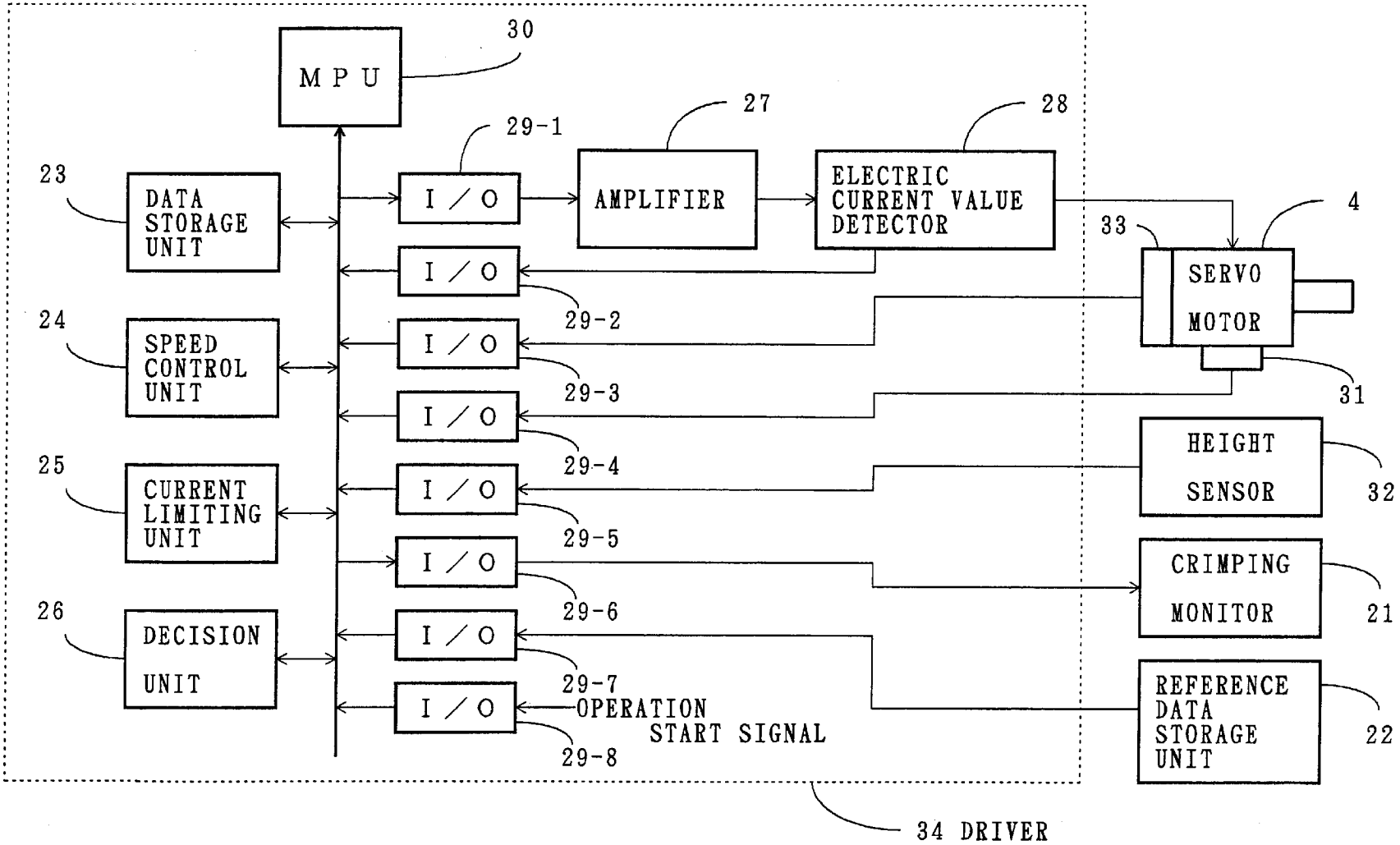
FIG. 3 is a function block diagram showing the control sequence of the terminal crimping device of FIG. 1.

FIG. 3 is a function block diagram of the driver 34 which drives the servo motor 4. As shown therein, the driver 34 is incorporated as a control circuit like a central processing unit; that is, said driver 34 is composed of data storage unit 23, speed control unit 24, current limiter 25, a decision unit 26, amplifier 27, a electric current value detector 28, an interface (I/O) 29 (29-1 through 29-8) and a microprocessor (MPU) 30 which performs the processing work.

Figure 10A:
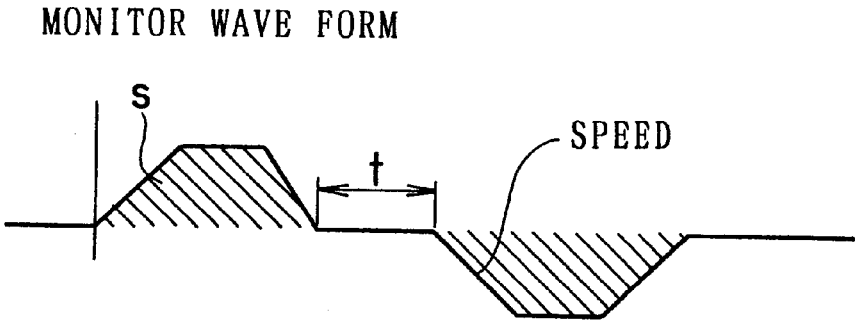
FIG. 10A PRIOR ART
FIGS. 10A and 10B are views for explaining the amended determination value.
Figure 10B:
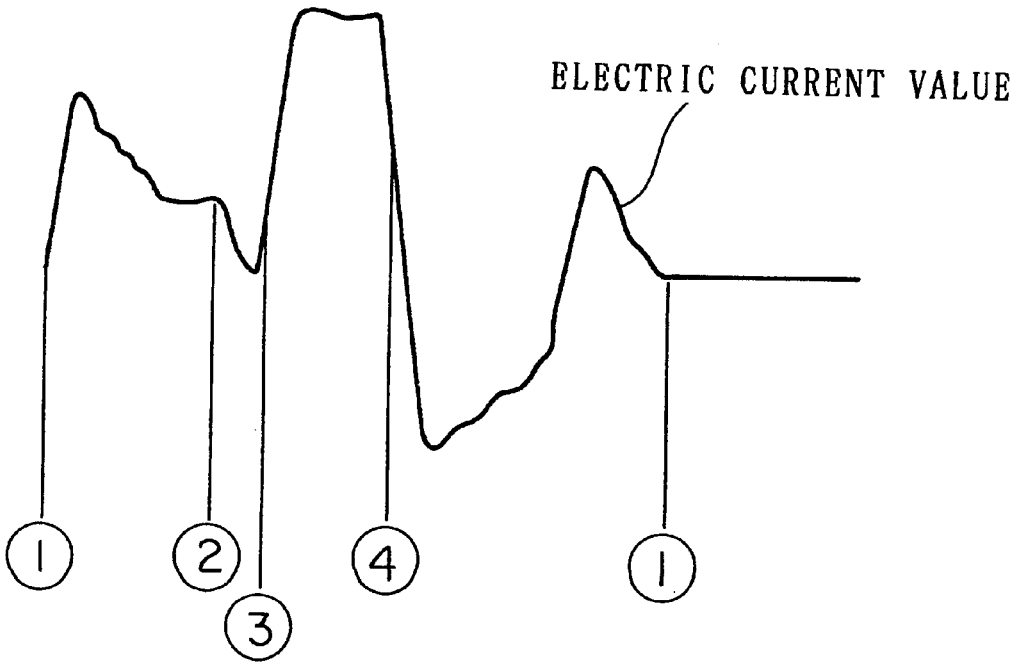
FIG. 10B PRIOR ART
Figure 11A:
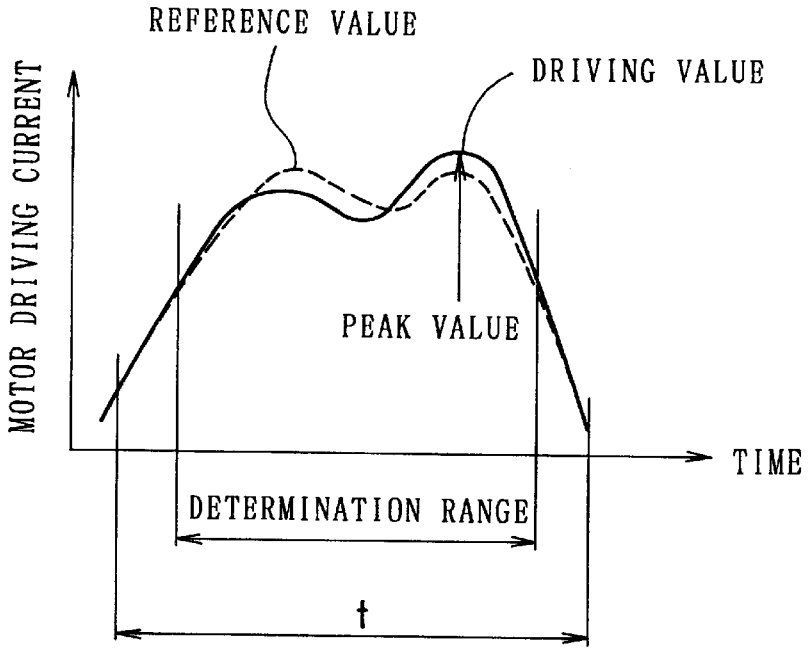
FIG. 11A PRIOR ART
FIG. 11A is a graph showing the relationship the time and the ascending/descending speed of the crimper at the time of crimping operation.

The operating principle of said terminal crimping device will not be explained since it is substantially the same as explained referring to FIGS. 10 and 11 which show the prior art.

Now back to FIG. 3, data for driving the terminal crimping device A and data for determining whether the performance of the terminal crimping operation is good or not will be stored in advance into the data storage unit 23 by way of I/O 29-7 from the reference data input unit 22 prior to starting the operation of the terminal crimping device A.

Figure 11B:
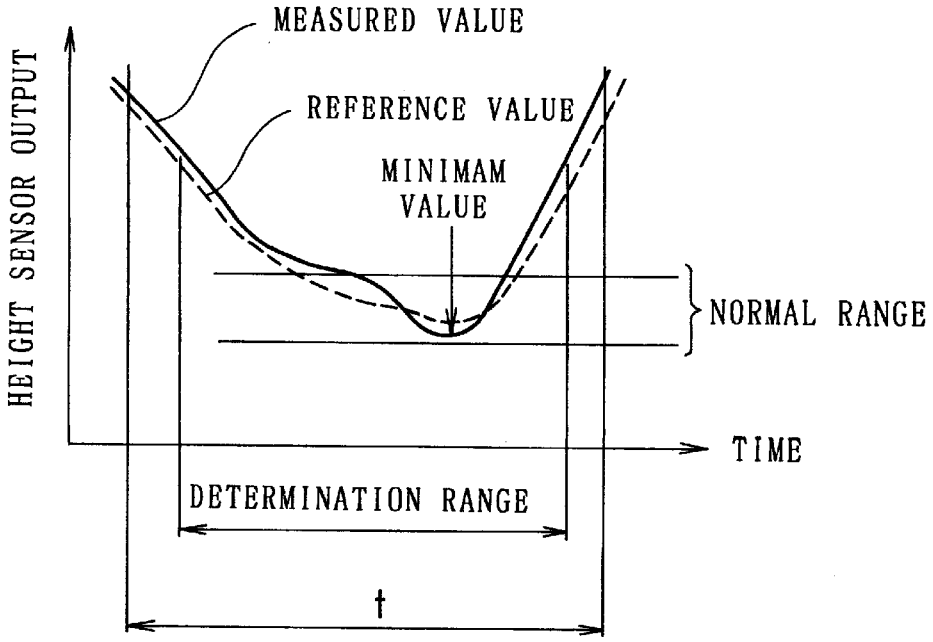
FIG. 11B PRIOR ART
FIG. 11B is a similar graph showing the relationship between the time and the motor current.

More specifically, the data to be stored for driving the terminal crimping device A as shown in FIG. 11B include (i) the acceleration after the start of a forward rotation of the motor and the position of the crimper 14 descending by the rotation of the motor at the time of the motor reaching a uniform speed, (ii) the position of the crimper 14 decelerated from the uniform speed and the deceleration at that time, iii) the position of the crimper 14 at the time of starting the crimping, the given time period t and the drive current for driving the motor for said given time period, and iv) the acceleration at the time of reversing the motor after completion of the crimping to elevate the crimper 14, the position of the crimper 14 when the motor speed is brought to a uniform speed, the position of the crimper 14 when the motor is decelerated, and the position of the crimper 14 at a stop.

The positions of the crimper 14 are stored as values related to the output values of the rotary encoder 33 attached to the servo motor 4.

These data are obtained by conducting preliminary experiments for respective terminals to be press attached and the thus obtained data are stored. In this connection, the data corresponding to a plurality of terminals may be stored such that a relevant data are to be read out at the time of the operation.

The positions of the crimper 14 are to be stored in the form of values corresponding to the rotational angles of the disk 7 such that there is no need for varying the level of the anvil as required in the prior art even in the event of terminal replacement; that is, the procedure can be followed immediately to facilitate the adjustment of the crimper position at the start of crimping.

The data for determining whether the performance of the terminal crimping operation is good or not will be explained later on.

Figure 4:
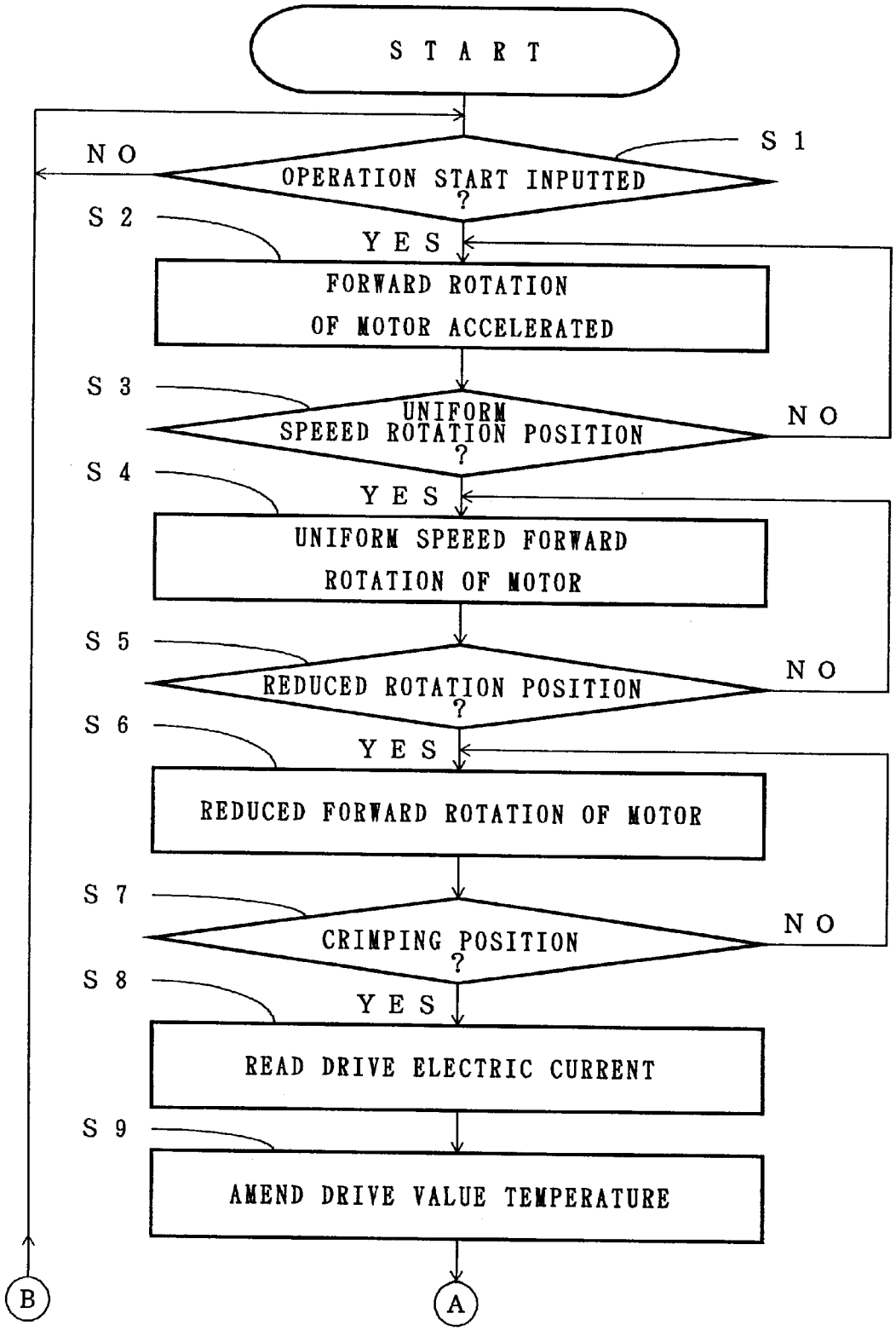
FIG. 4 is a flow chart showing the operation of FIG. 3.

Next, the operation of the driver 34 will be explained with reference to FIGS. 4 and 5, which show a flow chart of the driver operation.

At step S1, the speed control unit 24 determines whether or not the signal for starting the crimping operation has been inputted and if the determination is NO, the program is suspended until YES.

At step S2, the speed control unit 24 reads out from the data storage unit 23 the acceleration for causing the servo motor 4 to rotate forwardly and said acceleration is outputted to the amplifier 27 by way of I/O 29-1 where the power amplification is effected to supply the electric current to the servo motor 4 such that the required speed is obtained.

In this connection, the acceleration for the motor rotation is obtained by reading out the output value of the rotary encoder 33 by way of I/O 29-3, differentiating the read out value to obtain the speed, and further differentiating the speed to obtain the acceleration.

At the step S3, the speed control section 24 determines whether or not the output value of the rotary encoder 33 inputted by way of I/O 29-3 has become a uniform rotation position and if the determination is NO, the acceleration applied at step S2 is continuously effected and if YES, the program proceeds to step S4 where the uniform speed rotation is effected.

Further, if the position for decelerated rotation is detected at the step S5, the program proceeds to step S6 where the speed control unit 24 reduces the motor rotation. At step 7, the terminal reaches the crimping position, when the current control unit 25 is thus notified.

At step S8, the current control unit 25 reads out the electric current value I which is stored at the data storage unit 23 to be supplied to the servo motor 4 at the time of terminal crimping operation. Then, the program proceeds to step S9 where an amendment is made thereto on the basis of the temperature value from the temperature sensor 31 inputted by way of I/O 29-4 such that the torque of the servo motor 4 reaches the prescribed value to output the value at step S10 by way of I/O 29-1.

At step S11, the decision unit 26 stores the determination data to a memory not shown. Said data for determination will be explained in detail later on.

At step 12, the electric current control unit 25 determines whether or not the electric current I is supplied to the servo motor 4 for a time period t and if the determination is NO, the program proceeds to the step S10 for execution of the steps S10 and S11.

At step 13, the speed control unit 24 causes the servo motor 4 to rotate by accelerating the same to obtain a designated acceleration in the backward direction until a value for the uniform speed rotation is determined at step S14 as having been obtained. Then, the program proceeds to step S15 to achieve a uniform speed rotation. At the step 16, if the position for reduction speed rotation is determined as having been reached, the program proceeds to step S17 for decelerated rotation, and at step S18 the rotation is stopped when the stop position is reached.

At step S19, the decision unit 26 determines whether crimping is good or not on the basis of the data recorded at the step S11 in accordance with the flow shown in FIG. 6 described below. Then, at the step 20, an alarm is issued if necessary in the event of "not good" while the result is displayed 21 on the crimping monitor 21.

The determination whether the crimping is good or not is recorded at the step S11 as shown in FIG. 11 at an interval of predetermined time period in the form of the electric current value (drive value) detected by the current value detector 28 as having flowed through the servo motor 4 and the height detected by the height sensor 32 are recorded.

The current control unit 25 controls such that the uniform electric current having a value stored at the data storage unit 23 is supplied to the motor. Although a uniform electric current is supplied while the motor is at a stop, the control balance is lost by crimping operation when the motor starts to rotate with the result that the drive electric current varies. When crimping a terminal to a coreless cable or an unpeeled cable, it is often observed that the current supplied is larger than when crimping a normal terminal or that the total supply electric current is smaller. Therefore, the determination of good or not in accordance with the preset amount is effected on the basis of a variation of the current supplied in correspondence with the crimping height.

Figure 5:
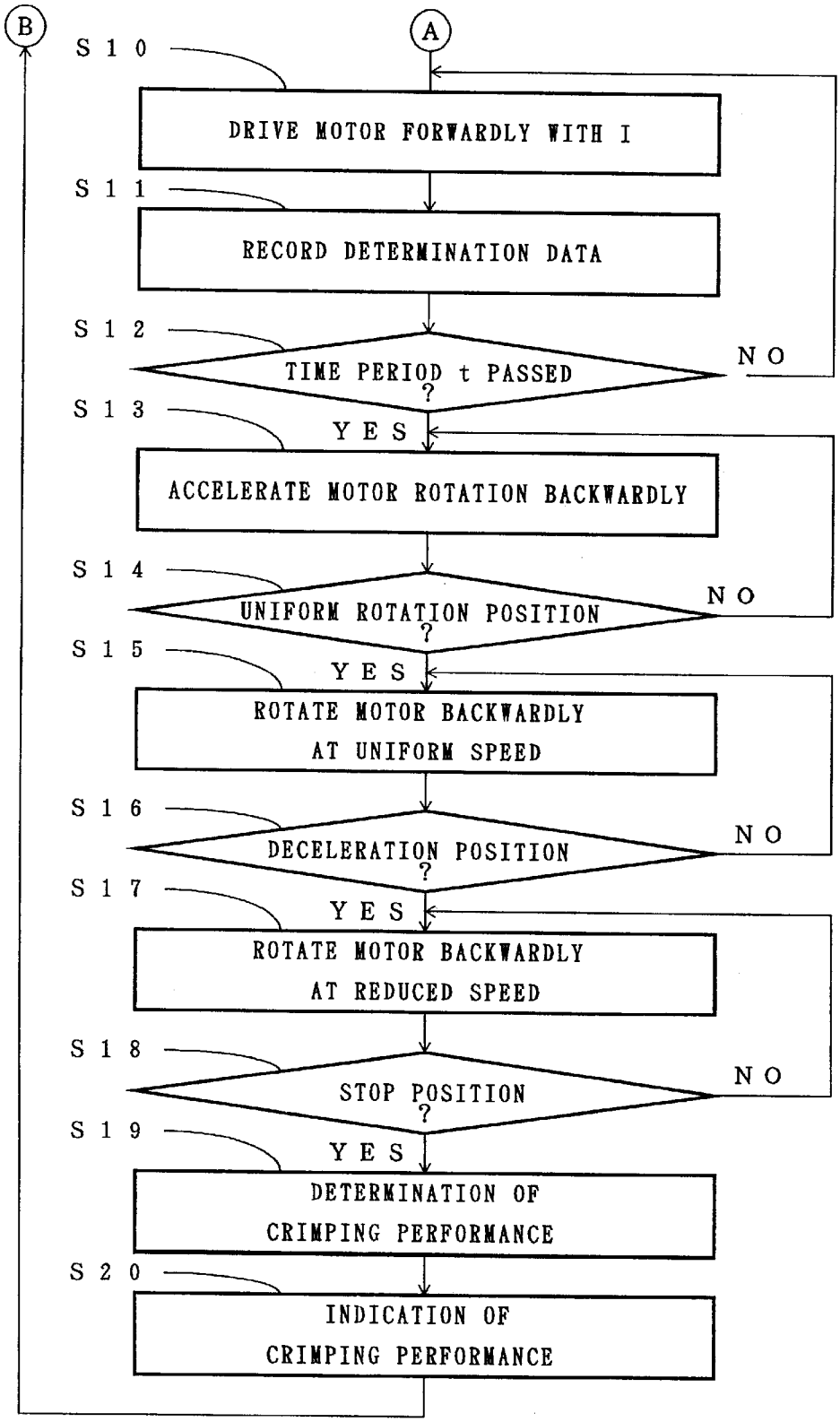
FIG. 5 is a flow chart showing the operation of FIG. 3.
Figure 6:
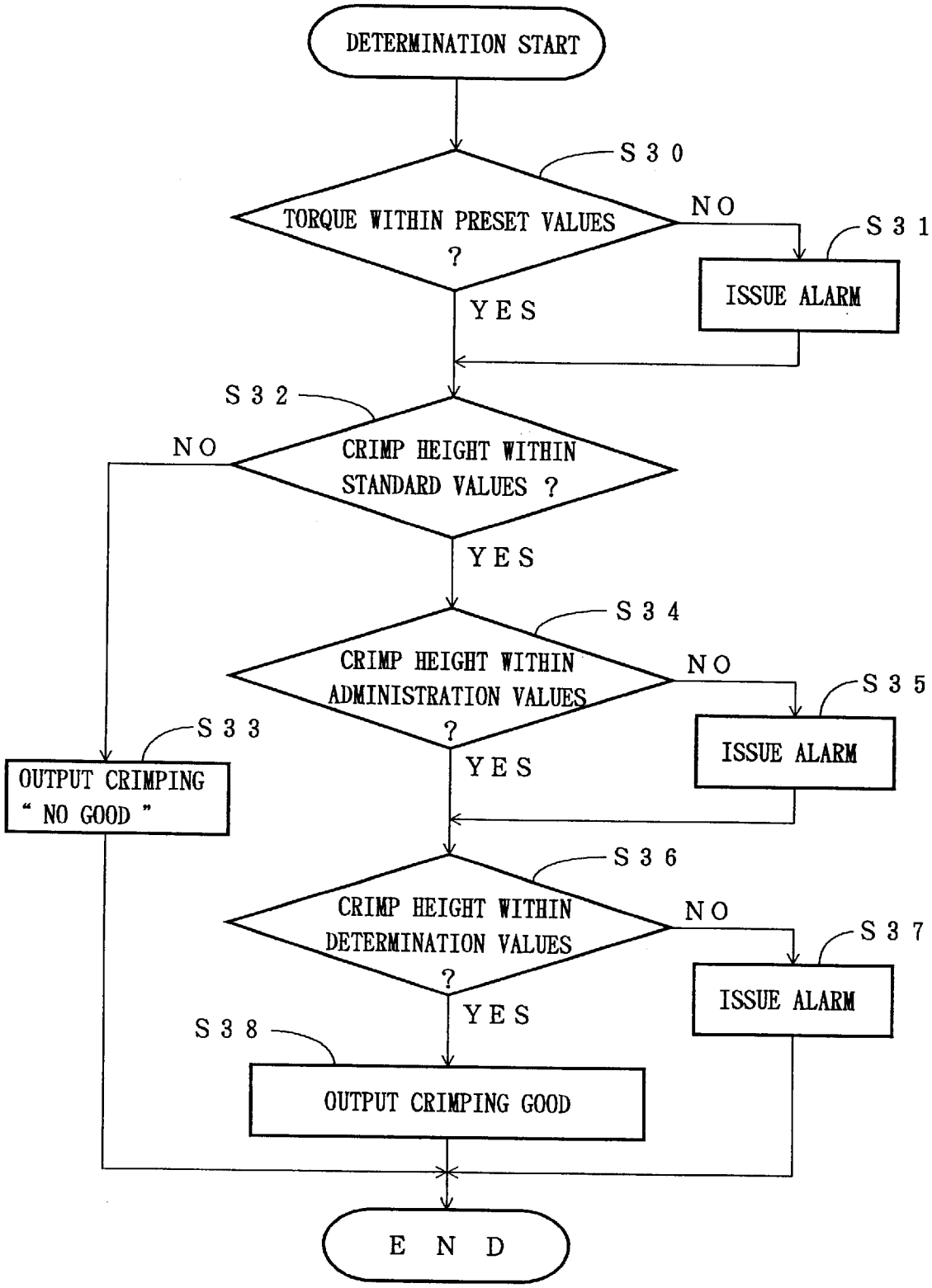
FIG. 6 is a flow chart showing the determination value amending operation.
Figure 7:
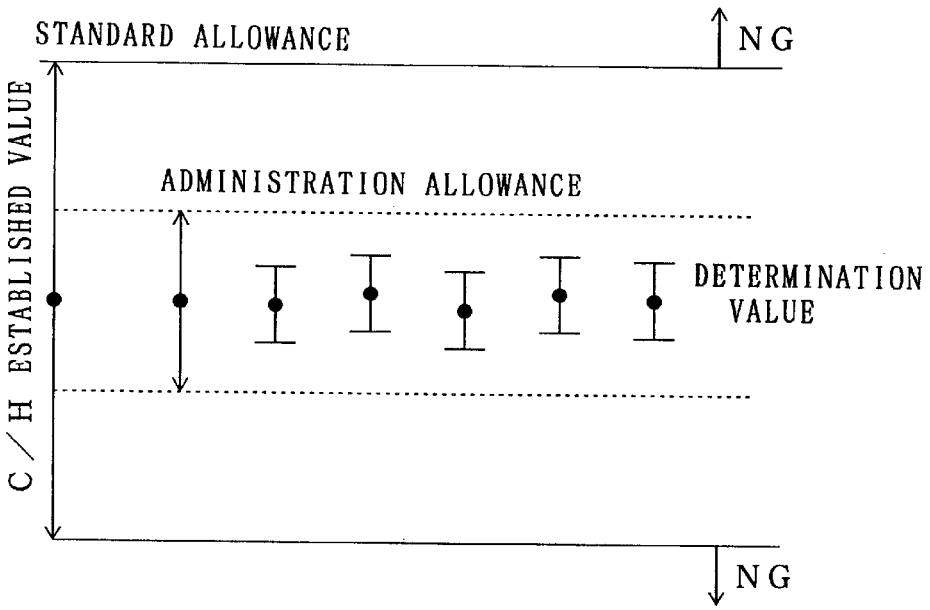
FIG. 7 is a view for explaining the determination value.

The determination of the result of crimping in the step S19 in FIG. 5 is effected by following the flow shown in FIG. 6.

At the step S30, the decision unit 26 determines whether the torque value is in conformity with the predetermined value or not, and if NO, the program proceeds to the step S31 to issue an alarm.

Figure 8:
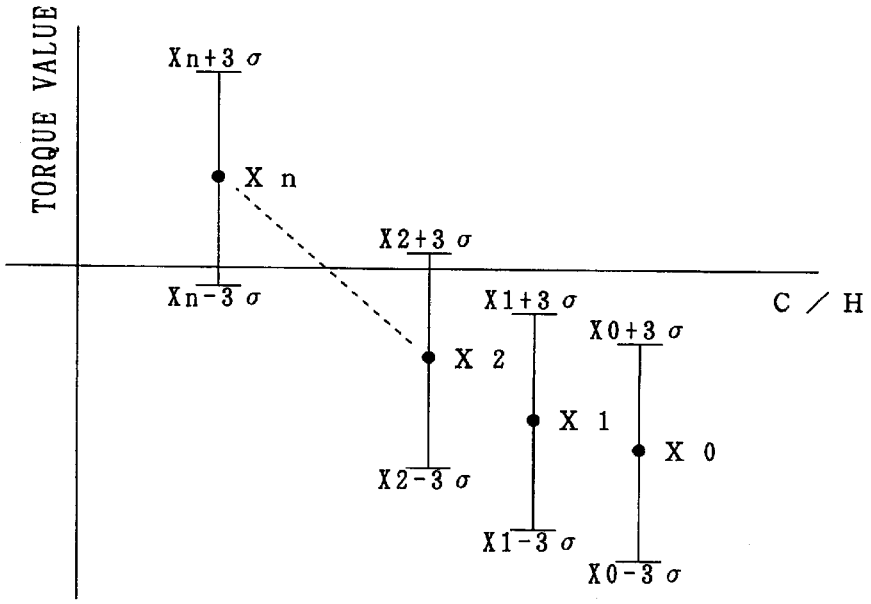
FIG. 8 is a view for explaining the determination value amendment.
Figures 1, 9A, 9B, 9C:
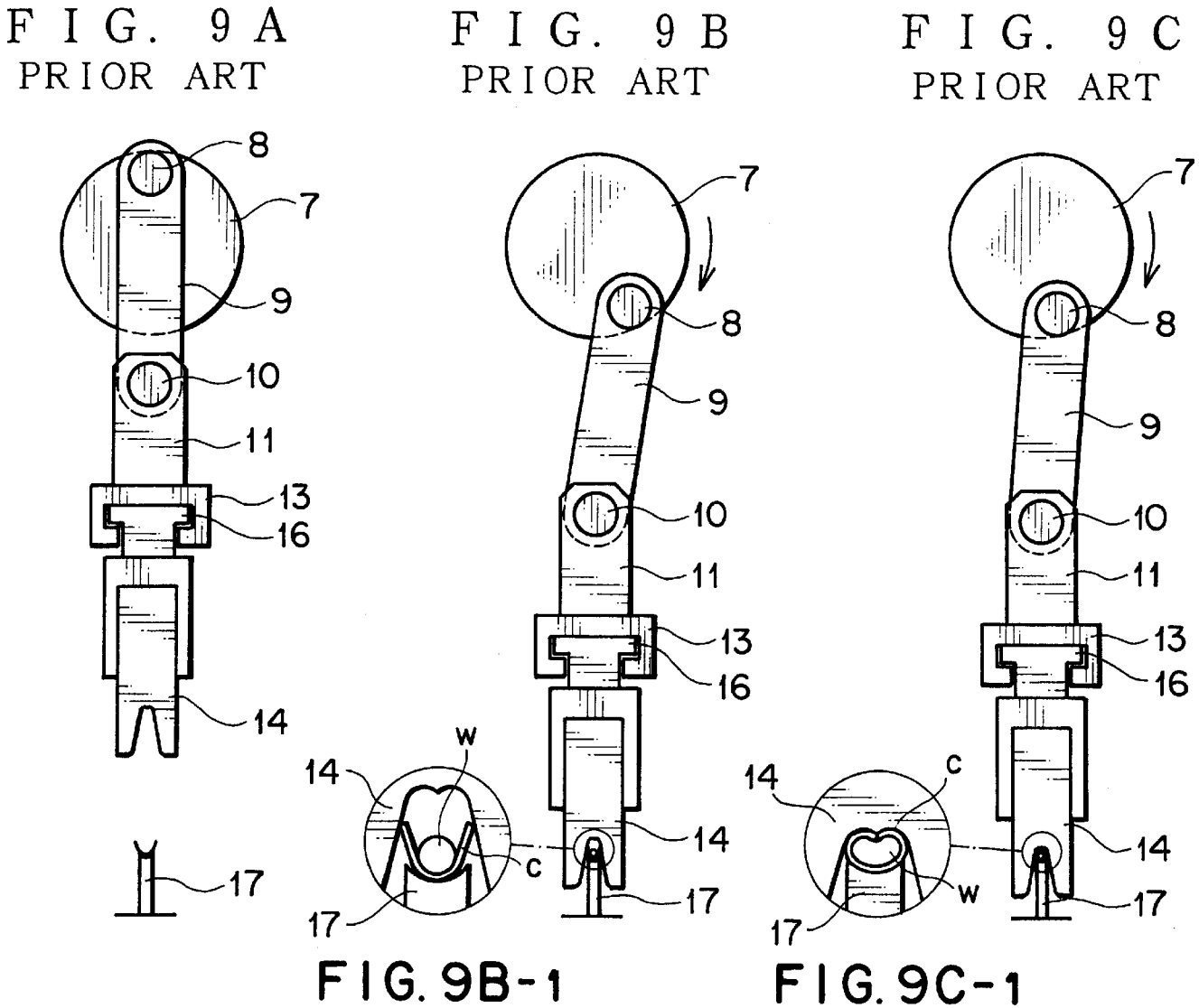
FIG. 9A PRIOR ART
FIG. 9B PRIOR ART
FIG. 9C PRIOR ART
FIGS. 9A through 9C are views explaining the operation of the terminal crimping device (shown in FIG. 1)

At the decision unit 26, the reference values X0, X1, X2, - - - Xn of torque values (electric current values) to the crimp height (C/H) are recorded in advance as shown in FIG. 8. Further, the predetermined value ($3\sigma$) to each reference value of the X0, X1, X2, - - - Xn is recorded there.

The determination at the step S30 is done by determining whether or not the data values recorded at the step S11 is within the range of allowances of predetermined values and if therewithin, the determination is good and if outside thereof, "not good".

At the step S32, it is determined whether the height of the crimper is within the predetermined values and if the determination is NO, the program proceeds to the step S33 to issue a signal of terminal crimping being not good.

In other words, the standard values for determining whether or not within the range of the standard values for the height of the crimper (C/H), the administration values for administering the height of the crimper for the press attached terminal and the decision values for determining whether or not terminal crimping operation is good or not are recorded at the step 26 while the determination is effected as to whether the height of the crimper is within the range of the standards for the height of the crimper for the press attached terminals.

Next, at the step S34, it is determined whether or not the height of the crimper is within the administration values and if NO, the program proceeds to the step S35 to issue an alarm.

Further, at the step 36, it is determined whether the height of the crimper is in conformity with the decision values or not and if NO, the program proceeds to the step 37 to issue an alarm.

As detailed in the foregoing description, the height of the crimper is determined on the basis of the standard values, the administration values and the decision values, the determination of the crimping operation is reliably effected.

What is claimed is:

1. A method of controlling a terminal crimping device composed of an elevating crimper for crimping terminals on exposed conductors of cables and an anvil positioned opposite said elevating crimper, wherein said crimper is caused by drive means including a servo motor to perform an elevating action, said method comprising the steps of:

recording a standard crimper height value;

monitoring a crimper height and comparing a monitored crimper height with the standard crimper height value;

determining whether a terminal crimping performance is acceptable or not by determining whether said monitored crimper height is out of conformity with said standard crimper height value; and issuing an alarm when said monitored crimper height at the terminal crimping operation is out of conformity with said standard crimper height value.

2. A method of controlling a terminal crimping device according to claim 1, wherein said step of determining whether the terminal crimping performance is acceptable or not is based on said step of monitoring the height of the crimper at the time of terminal crimping operation and a step of monitoring a load applied to said drive means; and comparing a load to the detected height with preset reference data.

3. A method of controlling a terminal crimping device composed of an elevating crimper for crimping terminals on exposed conductor of cables and an anvil positioned opposite said elevating crimper, wherein said crimper is caused by drive means including a servo motor to perform an elevating action, said method comprising the steps of:

recording a standard crimper height value, an administration crimper height value and a determination crimper height value, said standard crimper height value being larger than said administration crimper height value and said administration value being larger than said determination value;

monitoring a crimper height and comparing a monitored crimper height with the standard crimper height value;

when said monitored crimper height is larger than said crimper height value, determining that a terminal crimping performance is not acceptable;

monitoring the crimper height and comparing it with said administration crimper height value and further with said determination crimper height value;

issuing an alarm when said monitored crimper height is larger than said administration crimper height value and when it is larger than said determination crimper height value; and only when the crimper height value is smaller than said administration value and also smaller than said determination value, determining that the terminal crimping performance is acceptable.

* * * * *